US010319045B2

(12) United States Patent
Frank

(10) Patent No.: US 10,319,045 B2
(45) Date of Patent: Jun. 11, 2019

(54) IDENTIFYING UNEXPECTED RELATIONSHIPS IN A SOCIAL NETWORKING SYSTEM

(71) Applicant: Jonathan H. Frank, Mountain View, CA (US)

(72) Inventor: Jonathan H. Frank, Mountain View, CA (US)

(73) Assignee: Facebook, Inc., Menlo Park, CA (US)

( * ) Notice: Subject to any disclaimer, the term of this patent is extended or adjusted under 35 U.S.C. 154(b) by 771 days.

(21) Appl. No.: 13/685,584

(22) Filed: Nov. 26, 2012

(65) Prior Publication Data

US 2014/0149500 A1 May 29, 2014

(51) Int. Cl.
*G06Q 50/00* (2012.01)

(52) U.S. Cl.
CPC ..... *G06Q 50/01* (2013.01)

(58) Field of Classification Search
None
See application file for complete search history.

(56) References Cited

U.S. PATENT DOCUMENTS 7,117,185 B1 * 10/2006 Aliferis et al. ..... 706/12
7,844,671 B1 * 11/2010 Lawler et al. ..... 709/206
8,112,417 B2 * 2/2012 Berger et al. ..... 707/723
8,484,297 B2 * 7/2013 Huang ..... 709/206
2009/0070684 A1 * 3/2009 Aldrich et al. ..... 715/743
2011/0211737 A1 * 9/2011 Krupka et al. ..... 382/118
2011/0314017 A1 * 12/2011 Yariv et al. ..... 707/737
2014/0089327 A1 * 3/2014 Pavlidis et al. ..... 707/749
2014/0129629 A1 * 5/2014 Savir et al. ..... 709/204

* cited by examiner

*Primary Examiner* — Jason D Recek
*Assistant Examiner* — Lesa M Kennedy
(74) *Attorney, Agent, or Firm* — Fenwick & West LLP

(57) ABSTRACT

A social networking system identifies relationships between friends of a target user that are likely to be unexpected to the target user. To identify an unexpected relationship among a user's friends, the social networking system determines a measure of unexpectedness for pairs of connections of the target user and selects pairs of connections for presentation to the user based on the measure of unexpectedness. The measure of unexpectedness of a relationship between a pair of friends is inversely related to a number of connections between each of the pair of friends and the target user. Information describing the pair of unexpected friends may be presented to a target user along with content relating the two friends, such as photos in which both friends are tagged, events attended by the unexpected friends together, or places both unexpected friends checked-in at the same time.

17 Claims, 4 Drawing Sheets

IDENTIFYING UNEXPECTED RELATIONSHIPS IN A SOCIAL NETWORKING SYSTEM

BACKGROUND

This invention relates to determining relationships in social networking systems and in particular to determining an unexpected relationship between a pair of friends of a user of a social networking system.

Social networking systems store social information provided by users including but not limited to hometown, current city, education history, employment history, photos, and events the user participated in the user's profile. Social networking systems allow users to create connections with friends and interact with each other. Social networking systems allow users to view other user's profile, organize events, and invite friends to participate in those events.

Users spend time in a social networking system viewing other users' profiles, pictures, and posts. Oftentimes, users find value in using a social networking system because they can obtain information and updates about their friends that would otherwise have been hard to obtain. For example, a user may have a friend that moved abroad. Using the social networking system, the user can find out about the friend's activities and see the friend's information, for example, view photos posted by the friend to the social networking system. A social networking system has large amount of information describing each user and the relationships among the users. But because there is so much information, certain useful information may be hidden or difficult to determine unless a user luckily happens upon a fact that is interesting to the user.

SUMMARY

To help a user identify interesting and useful facts from the information available to the user in a social networking system, embodiments of the invention identify of an unexpected relationship among the user's friends in the social networking system. A relationship may be unexpected to a user if two of a user's friends have a connection in a social networking system and the user is not aware of this relationship between the friends. For example a user may have friends from two different groups, such as friends from high school and friends from karate club. Those two groups, also called relationship circles, may be generally non-overlapping, so the user may not expect a friend from one circle to have a connection with a friend in the other circle. In some cases, if such a connection exists and the user is not aware of the connection, that pair of friends is said to have an unexpected relationship, from the perspective of the user. Often, the unexpected relationship was formed through a social channel of which the user is not a part.

Embodiments of the invention present one or more unexpected relationships to a user of a social networking system. In one embodiment, a target user is identified for finding unexpected relationships. Other users connected to the target user via the social networking system are identified (called friends or connections of the user). Among these friends of the user, one or more pairs of friends of the target user who are connected to each other are further identified. A measure of unexpectedness of each identified pair of friends of the target user is determined, and one or more pairs of friends are selected based on the measure of unexpectedness. In an embodiment, the measure of unexpectedness of a pair of friends of the target user is inversely related to a number of common friends between each of the pair of friends and the target user. Once the pair of friends having the unexpected relationship is selected, information describing the unexpected relationship is sent to the user for display.

In other embodiments, the information is presented to the user along with content available in the social networking system about the unexpected relationship. For example, the content can be a photo where both friends are tagged; an event both friends attended; or a restaurant in which both friends checked-in at the same time.

The features and advantages described in this summary and the following detailed description are not all-inclusive. Many additional features and advantages will be apparent to one of ordinary skill in the art in view of the drawings, specification, and claims.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

A social networking system allows users to communicate and interact with other users of the social networking system. A user is typically required to create an account with the social networking system to be able to use the functionality provided by the social networking system. A user may be required to authenticate to gain access to the user account. Once a user gains access to the user account, the user can view or modify the information stored with the user account as well as interact with other users. The social networking system can store information describing the user, for example, the user profile as well as information uploaded by the user including photos can be stored with the user account. A user that joins the social networking system can add connections to other users.

The term "friend" refers to any other user to whom a user has formed a connection, association, or relationship via the social networking system (friends are sometimes referred to as "connections"). Friends may be added explicitly by a user, for example, the user selecting a particular other user to connect to, or automatically created by the social networking system based on common characteristics of the users (e.g., users who are alumni of the same educational institution). The connection between users may be a direct connection; however, some embodiments of a social networking system 200 allow the connection to be indirect via one or more levels of connections. Moreover, the term friend need not require that the users actually be friends in real life; it simply implies a connection in the social networking system.

Friends may also be suggested by other users of the social networking system, or by the social networking system itself. The social networking system may identify other users the user may know based on the social information available to the social networking system. For example, if another user has many friends in common with the user, it is highly likely they are members of the same relationship circle and therefore the social networking system may suggest this connection to both users.

Figure 1:
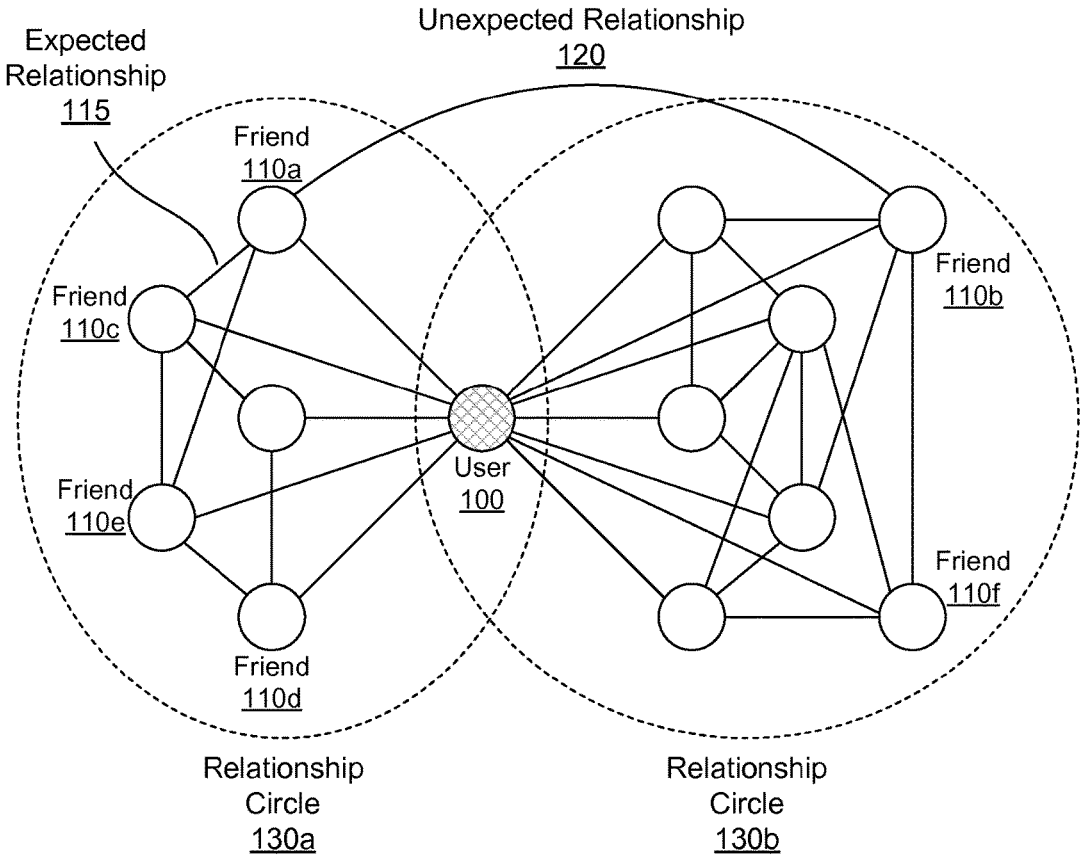
FIG. 1 is a diagram of the connections a user can have in a social networking system, in accordance with an embodiment of the invention.

FIG. 1 is a conceptual diagram of the connections a user 100 can have in a social networking system. FIG. 1 is an overall description of the invention and illustrates the idea of an unexpected relationship. FIG. 1 and the other figures use like reference numerals to identify like elements. A letter after a reference numeral, such as "130A," indicates that the text refers specifically to the element having that particular reference numeral. A reference numeral in the text without a following letter, such as "130," refers to any or all of the elements in the figures bearing that reference numeral (e.g., "130" in the text refers to reference numerals "130A" and/or "130B" in the figures).

User 100 has several friends 110, and some of the user's friends 110 may belong to a relationship circle 130. A friend is said to belong to a relationship circle when the friend has connections with a significant number of members of the circle, for example, more than a threshold number of members. The relationship circles 130 need not be explicit or actively join, but rather are a convenient mechanism for describing embodiments of the invention. Examples of relationship circles include users graduating in the same class, users that are part of a club, and/or users that work in the same company. Relationship circles are usually close groups of friends, and most users in the relationship circle know each other, such that their relationships are expected to other users who are members of the same relationship circle 130.

Since the graph diagram in a social networking system are not a true representation of all the connections in the real world, a friend who is member of a relationship circle does not need to have connections with all members of the same relationship circle. As shown in FIG. 1, user 100 has two friends 110*a* and 110*d* that are members of the relationship circle 130*a* but are not connected to each other in the social networking system. This happens due to the way connections are made in the social networking system, and this does not necessarily mean friend 110*a* and friend 110*d* do not actually know each other.

In some occasions, two friends of a user may have a connection with each other even though they belong to two different relationship circles and do not share a relationship circle. This relationship between the two friends is oftentimes unknown by the user, and the existence of the relationship is most likely unexpected by the user of the social networking system. Such relationships are thus referred to as unexpected relationships. This is also true when both friends belong to a relationship circle of which the user is not a member. The user will most likely not have knowledge of the relationship circle or many of its members. In this case, the relationship between the pair of friends is still unexpected because the user is unaware of the relationship circle that includes both friends.

As an example, a user can have a relationship circle 130*a* that includes all of his friends from high school. Since all the members of the relationship circle 130*a* were classmates, every member of the relationship circle 130*a* will most likely be friends with every other member of the relationship circle 130*a* (expected friends). Therefore, the fact that a friend 110*a* from the relationship circle 130*a* has a connection with another friend 110*c* from the same relationship circle 130*a* would not be an unexpected relationship for the user. Therefore, the connection between friend 110*a* and friend 110*c* is an expected relationship 115 for the user. Similarly, the user may have a second relationship circle 130*b* that includes all members of his karate club. All members of the karate club relationship circle 130*b* will most likely be friends with each other (expected friends). In contrast, it is unlikely that a friend from the high school relationship circle 130*a* would have a connection with a friend from the karate club relationship circle 130*b*. In some occasions, friends from two different circles (e.g., one friend 110*a* from the high school relationship circle 130*a* and one friend 110*b* from the karate club relationship circle 130*b*) are friends with each other. If the user is not aware of that relationship, then the relationship is an unexpected relationship 120.

In the real world, and without the help of a social networking system, finding unexpected relationships between two friends of a user is likely to be very difficult. In some rare occasions, unexpected relationships may be discovered by accident, but in most cases they are left unnoticed. Because of the vast information available in social networking systems, it is possible to determine the existence of such unexpected relationships using all the data available regarding user connections provided by users of the social networking system.

System Environment for Identifying Unexpected Relationships

Figure 2:
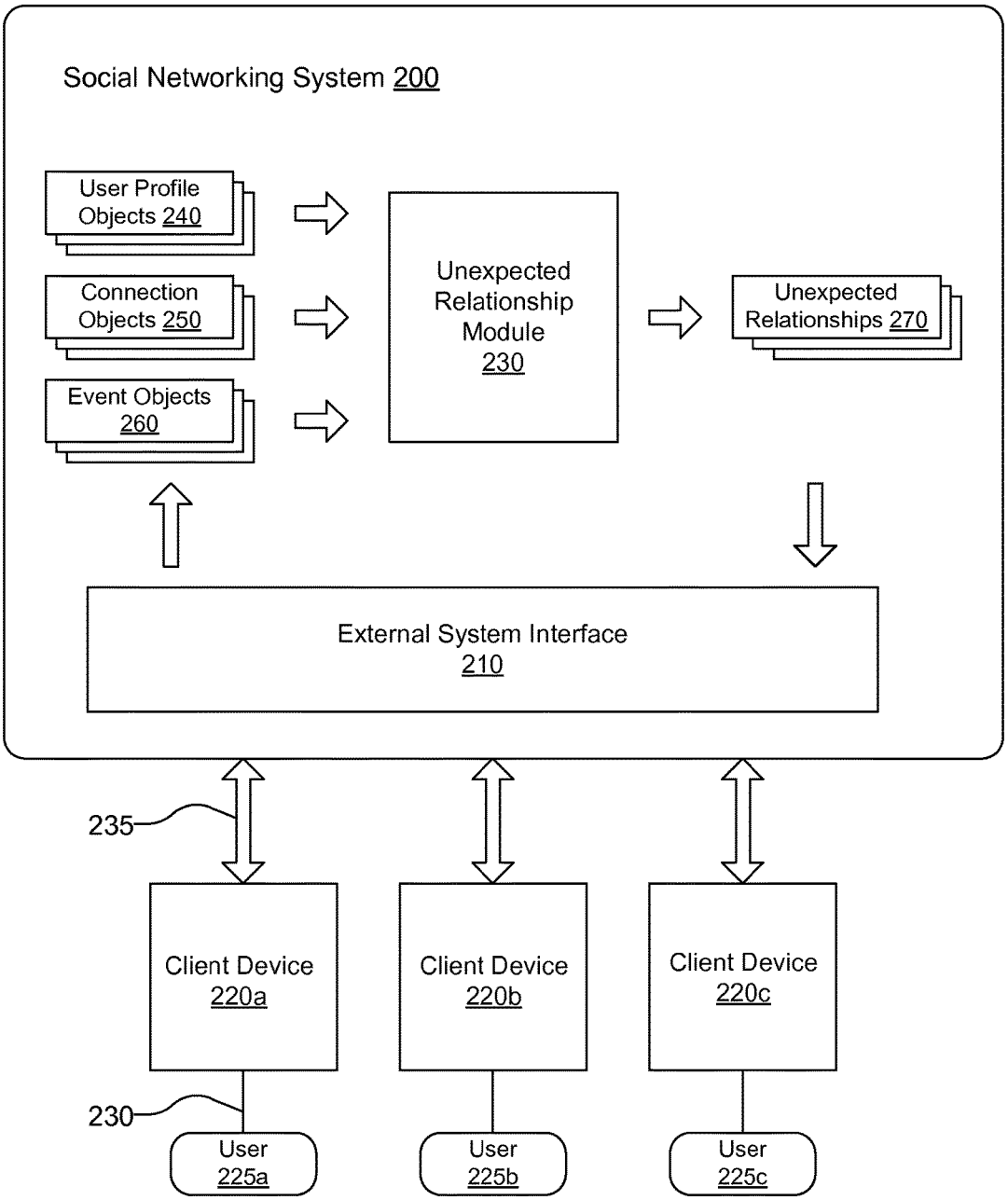
FIG. 2 is a diagram of a system environment for identifying an unexpected relationship among a user's friends in a social networking system, in accordance with an embodiment of the invention.

FIG. 2 is a diagram of a system environment for identifying pairs of unexpected friends as seen by a target user, in accordance with an embodiment of the invention. The users 225 interact with the social networking system 200 using client devices 220. Some embodiments of the system 200 have different and/or other modules than the ones described herein, and the functions can be distributed among the modules in a different manner than described here. As shown in FIG. 2, users 225 use the client devices 220 to interact with the social networking system 200. The social networking system 200 maintains several objects 240, 250, 260 describing the users and their relationships and interactions, as well as other entities within the social networking system. The unexpected relationship module 230 analyzes the information available in these objects to determine unexpected relationships and presents the information to the users that are likely to be interested in the information.

In one embodiment, the client device 220 used by a user 225 for interacting with the social networking system 200 can be a personal computer (PC), a desktop computer, a laptop computer, a notebook, a tablet PC executing an operating system, for example, a Microsoft Windows-compatible operating system (OS), Apple OS X, and/or a Linux distribution. In another embodiment, the client device 220 can be any device having computer functionality, such as a personal digital assistant (PDA), mobile telephone, smart phone, etc.

In some embodiments, the client device 220 may use a web browser, such as Microsoft Internet Explorer, Mozilla Firefox, Google Chrome, Apple Safari and/or Opera, as an interface to interact with the social networking system. In other embodiments, specialized application software that runs native on a mobile device is be used as an interface to interact with the social networking system.

The social networking system 200 offers its users the ability to communicate and interact with other users of the social networking system 200. Users join the social networking system 200 and then add connections to a number of other users of the social networking system 200 to whom they desire to be connected.

The social networking system 200 maintains different types of objects representing entities, for example, user profile objects 240, connection objects 250, event objects 260, and unexpected relationship objects 270. An object may be stored for each instance of the associated entity. A user profile object 240 stores information describing a user of the social networking system 200. A connection object 250 stores information describing relations between two users of the social networking system or in general any two entities represented in the social networking system 200. The event objects 260 store representations of real-world events in the social networking system 200. The unexpected relationship objects 270 store unexpected relationships identified by the unexpected relationship module 230. These objects are further described in detail herein.

Figure 3:
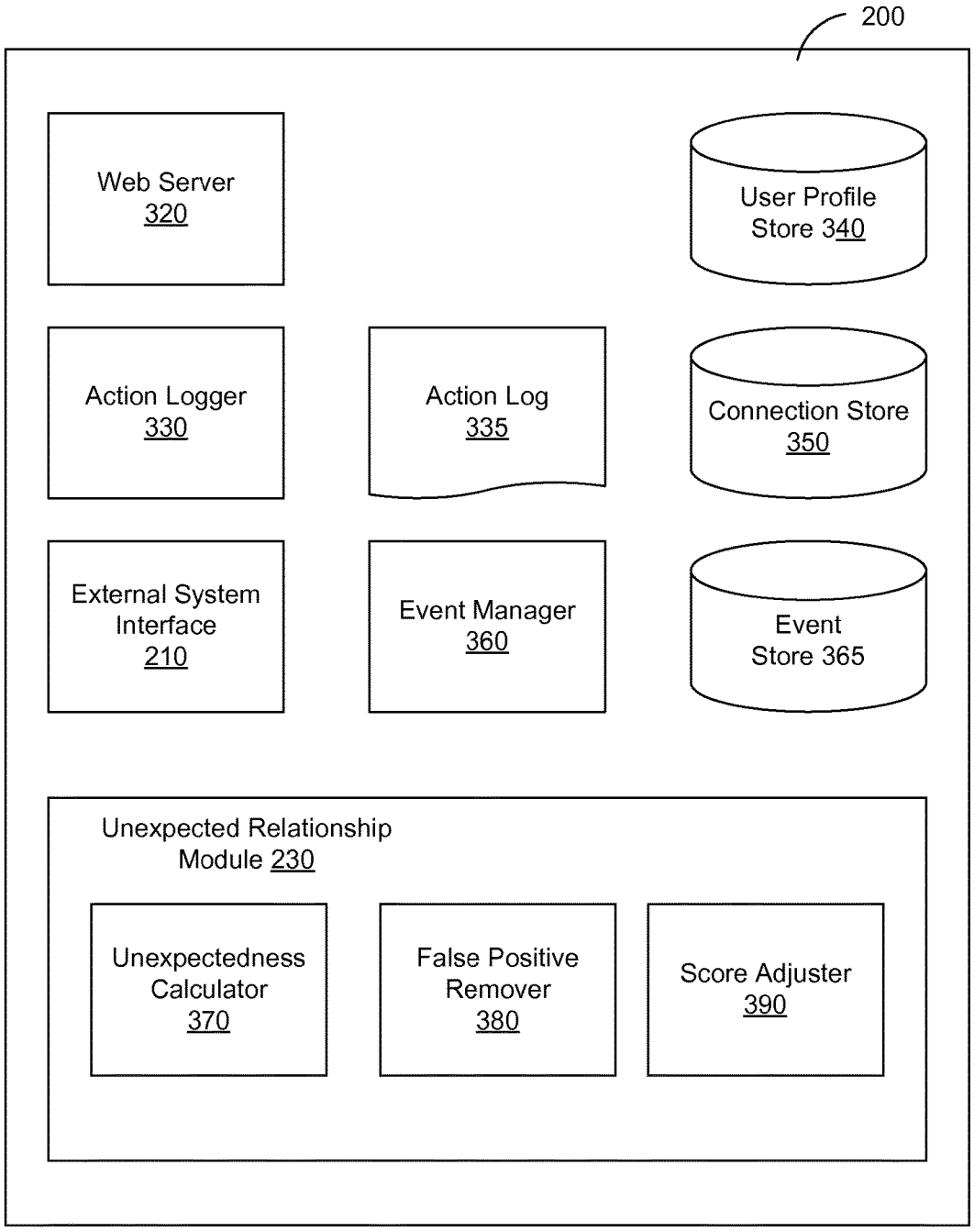
FIG. 3 is a diagram of the system architecture of a social networking system for identifying an unexpected relationship among a user's friends in a social networking system, in accordance with an embodiment of the invention.

The social networking system 200 comprises modules other than those shown in FIG. 2, for example, modules illustrated in FIG. 3 that are further described herein.

Social Networking System Architecture

FIG. 3 is a diagram of system architecture of a social networking system 200 for determining pairs of unexpected friends as seen by a target user, in accordance with an embodiment of the invention. The social networking system 200 includes a web server 320, an external system interface 210, an action logger 330, an action log 335, an event manager 360, an event store 365, a user profile store 340, and a connection store 350. In other embodiments, the social networking system 100 may include additional, fewer, or different modules for various applications. Conventional components such as network interfaces, security mechanisms, load balancers, failover servers, management and network operations consoles, and the like are not shown so as to not obscure the details of the system.

The social networking system 200 allows users to communicate or otherwise interact with each other and access content, as described herein. The social networking system 200 stores user profile objects 240 in the user profile store 340. The information stored in user profile store 340 describes the users of the social networking system 200, including biographic, demographic, and other types of descriptive information, such as work experience, educational history, gender, sexual preferences, hobbies or preferences, location, and the like. The user profile store 340 may also store information provided by the user, for example, images, videos, comments, and status updates. Images of users may be tagged with the identification information of the appropriate users displayed in an image.

Any action that a particular user takes using the social networking system 200 is associated with the user's profile 240, through information maintained in a database or other data repository. Such actions may include, for example, adding a connection to another user, sending a message to another user, reading a message from another user, viewing content associated with another user, attending an event posted by another user, among others. In addition, a number of actions described below in connection with other objects are directed at particular users, so these actions are associated with those users as well.

The connection store 350 stores data describing the connections between different users of the social networking system 200, for example as represented in a connection object 250. The connections are defined by users, allowing users to specify their relationships with other users. For example, the connections allow users to generate relationships with other users that parallel the users' real-life relationships, such as friends, co-workers, partners, and so forth. In some embodiments, the connection specifies a connection type based on the type of relationship, for example, family, or friend, or colleague. Users may select from predefined types of connections, or define their own connection types as needed.

The event store 365 stores information describing events associated with the social networking system 200. An event object 260 may be defined for a real-world event, such as a birthday party, a baby shower, and/or a high school reunion. A user interested in attending the event may establish a connection with the event object. A user may create the event object 260 by defining information about the event such as the time and place, a list of invitees, and the privacy of the event. Other users may send a reply to the invitation (an RSVP message) i.e., accept or reject the invitation, comment on the event, post their own content (e.g., pictures from the event), and perform any other actions enabled by the social networking system 200 for the event 260. Accordingly, the creator of the event object 260 as well as the invitees for the event may perform various actions that are associated with that event object 260. Furthermore, the event may be public, wherein any user of the social networking system is able to see details of the event and perform actions are associated with the event (e.g., comment on the event, post content, etc.); friends only, wherein only the invitees and their friends can see the details of the event and perform actions are associated with the event; or invitees only, wherein only users invited to the event, either by the creator of the event or another invitee, can see the details of the event and perform actions are associated with the event.

The web server 320 links the social networking system 200 via a network to one or more client devices 220; the web server 320 serves web pages, as well as other web-related content, such as Flash, XML, and so forth. The web server 320 provides the functionality of receiving and routing messages between the social networking system 200 and the client devices 320. These messages can be instant messages, queued messages (e.g., email), text and SMS (short message service) messages, or any other suitable messaging technique.

The action logger 330 is capable of receiving communications from the web server 320 about user actions on and/or off the social networking system 200. The action logger 330 populates the action log 335 with information about user actions to track them. Any action that a particular user takes with respect to another user is associated with each user's profile, through information maintained in a database or other data repository, such as the action log 335. Such actions may include, for example, adding a connection to the other user, sending a message to the other user, reading a message from the other user, viewing content associated with the other user, attending an event posted by another user, among others. When a user takes an action on the social networking system 200, the action is recorded in an action log 335. In one embodiment, the social networking system 200 maintains the action log 335 as a database of entries.

The unexpected relationship module 230 performs calculations based on knowledge available in the social networking system and assigns an unexpectedness score to each pair of friends of a user of the social networking system. The unexpected relationship module 230 contains the unexpectedness calculator 370, the false positive remover 380, and the score adjuster 390. Details of the unexpected relationship module 230 and its components are further described herein.

Determining Unexpectedness

The determination whether a relationship is unexpected is performed by the unexpectedness calculator 370. In one embodiment, the social networking system selects a target user and calculates an unexpectedness score for pairs of the target user's friends. The unexpectedness score is determined for pairs of friends who are connected to each other via the social networking system. Therefore, in some embodiments, to determine which friends are connected, the unexpectedness calculator creates an n×n square matrix, where n is the number of friends the target user has. The unexpectedness calculator assigns each column to a friend $f_i$ and each row to a friend $f_j$ (i.e., column 1 and row 1 are assigned to friend $f_1$, column 2 and row 2 are assigned to friend $f_2$, and so on). The unexpectedness calculator 370 populates a triangle of the friends matrix with either 1s, if friend $f_i$ and friend $f_j$ are connected; or 0s if friend $f_i$ and friend $f_j$ are not connected. In this way the unexpectedness calculator 370 identifies relationships among a user's friends so they can be tested for how likely they are to be expected by the user. An example of a friends matrix looks as follows:

| | $f_1$ | $f_2$ | $f_3$ | $f_4$ | $f_5$ | … | $f_{n-1}$ | $f_n$ |
|---|---|---|---|---|---|---|---|---|
| $f_1$ | – | 1 | 1 | 1 | 1 | | 0 | 0 |
| $f_2$ | – | – | 1 | 0 | 0 | | 0 | 0 |
| $f_3$ | – | – | – | 1 | 0 | … | 0 | 0 |
| $f_4$ | – | – | – | – | 0 | | 0 | 0 |
| $f_5$ | – | – | – | – | – | | 1 | 1 |
| ⋮ | | | ⋮ | | | ⋱ | | |
| $f_{n-1}$ | – | – | – | – | – | | – | 1 |
| $f_n$ | – | – | – | – | – | | – | – |

In this exemplary embodiment of a friends matrix, friend $f_1$ has connections with friends $f_2$, $f_3$, $f_4$ and $f_5$ but not with $f_{n-1}$ and $f_n$, similarly friend f2 has connections with friends $f_1$ and $f_3$ but not with $f_4$, $f_5$, $f_{n-1}$ and $f_n$. The main diagonal is not computed because a user cannot be a friend with himself. Furthermore, there is no need to calculate the lower triangle, since it is a mirror image of the upper triangle. Instead of computing the upper triangle of the friends matrix, a matrix with the same functionality can be constructed by computing only the lower triangle of the friends matrix and, as it will be apparent to one of ordinary skill in the art, there are many other ways of constructing the friends matrix.

The measure of unexpectedness of a relationship between two friends of the target user is inversely related to a number of common friends between each of the pair of friends and the target user. In an exemplary embodiment, the unexpectedness calculator 370 applies the following formula (1) to determine the unexpectedness score score(u, $f_i$, $f_j$):

$$\text{score}(u, f_i, f_j) = \frac{(1 + \#\text{friends } f_i \text{ shares with } u)\,(1 + \#\text{friends } f_j \text{ shares with } u)}{[1 + 2 \times (\#\text{friends in common with } f_i, f_j \text{ and } u)]^2} \quad (1)$$

In the equation (1), u refers to the target user, and $f_i$ and $f_j$ is a pair of friends of the target user for whom the unexpectedness score is determined. The constant value 1 added in each coefficient prevents each term from being zero. The constant multiplier 2 in the denominator is a weight on the relationship triangle. These values are empirically determined and may be replaced by other constant values. In the numerator, the term (1+# friends $f_i$ shares with u) is the number of friends $f_i$ and the target user have in common, and the term (1+# friends $f_j$ shares with u) is the number of friends $f_j$ and the target user have in common. The first term measures the degree of relationship between $f_i$ and the target user. The higher this value is, the closer the relationship between $f_i$ and the target user is. Similarly, the second term measures the degree of relationship between $f_j$ and the target user.

The first term in the numerator assesses how interesting a possible unexpected relationship that includes friend $f_i$ would be to the target user. Similarly the second term in the numerator assesses how interesting an unexpected relationship that includes friend $f_j$ would be to the target user. The target user will be more interested with an unexpected relationship that includes two of his close friends or at least one of his close friends as opposed to an unexpected relationship that includes a friend the target user has rarely met.

In the denominator, the term (# friends in common with $f_i$, $f_j$ and u) corresponds to the number of common friends between each of the first friend, the second friend, and the target user. This term relates to the unexpectedness of the relationship between $f_i$ and $f_j$ as seen by the target user. The lower this number, the more unexpected the relationship between $f_i$ and $f_j$ will be. $f_i$ and $f_j$ can have several friends in common, but as long as the target user does not have a connection with most of $f_i$ and $f_j$'s friends, the value of the denominator term will be low. For example the target user can have two friends, one from elementary school, and one from karate club. These two friends belong to two different relationship circles and the target user will not expect them know each other. It could be the case that both of the target user's friends went to summer camp together when they were ten. The target user's friends will have many friends in common, but since the target user did not go to that summer camp, he will not have knowledge of such relationship and will not have a connection with the friends that his two friends have in common. Therefore, the relationship will still be unexpected and the denominator term of the previously mention equation will be low, making the unexpectedness score high.

For example, in the exemplary relationship diagram of FIG. 1, the unexpectedness score between friend 110*a* and friend 110*b* can be calculated (i.e., score(user 100, friend 110*a*, friend 110*b*)). Friend 110*a* and the target user 100 have 3 friends in common (friend 110*b*, 110*c* and 110*e*); therefore the first term in the numerator (1+# friends friend $\mathbf{110}a_i$ shares with user 100) is equal to 4. Similarly friend 110*b* and the target user have 4 friends in common making the second term in the numerator 5. Since friend 110*a* and friend 110*b* are from two different relationship circles, they do not have many friends in common. In this example, they do not share any friend, making the denominator term $[1+2*(\#\text{ friends in common with friend } \mathbf{110}a\text{, friend } \mathbf{110}b \text{ and user } \mathbf{100})]^2$ to be equal to 1. As a result, the overall score computed by the unexpectedness calculator 370 is 20.

If both friends, $f_i$ and $f_j$, belong to the same relationship circle, then the relationship will not be unexpected. If this is the case, even though the numerator factors will be high for both friends, the denominator will also be high, making the overall score low.

For instance, in the exemplary relationship diagram of FIG. 1, the unexpectedness score between friend 110*a* and friend 110*e* can be calculated (i.e., score(user 100, friend 110*a*, friend 110*e*)). Friend 110*a* and the target user have 3 friends in common (friend 110*b*, 110*c* and 110*e*); therefore the first term in the numerator (1+# friends friend $\mathbf{110}a_1$ shares with user 100) is equal to 4. Similarly friend 110*e* and the target user 100 have 3 friends in common (friend 110*a*, 110*c* and 110*d*) making the second term in the numerator 4. Since friend 110*a* and friend 110*e* are from the same relationship circles, they do have many friends in common. In this example, they share one friend (friend 110*c*), making the denominator term $[1+2*(\text{\# friends in common with friend } \mathbf{110}a\text{, friend } \mathbf{110}e \text{ and user } \mathbf{100})]^2$ to be equal to 9. As a result, the overall score computed by the unexpectedness calculator 370 is 1.78, which is significantly lower than the score corresponding to relationship between friend 110*a* and friend 110*b*.

In some occasions, a friend can be a member of two relationship circles. For instance a user may have a friend from high school that also goes to karate club. This friend will not have an unexpected relationship with a friend that only goes to karate club and not to the user's high school. In this case the denominator in the unexpected relationship score formula is high since both friends and the user are all members of at least one relationship circle (karate club) making the overall unexpected relationship score low.

In another exemplary embodiment, the unexpectedness calculator 370 completes the relationship matrix by filling the lower triangle of the matrix using the values obtained for the upper triangle and assigning zeros to the elements in the main diagonal. Therefore an example of the new friends matrix looks as follows:

| | $f_1$ | $f_2$ | $f_3$ | $f_4$ | $f_5$ | … | $f_{n-1}$ | $f_n$ |
|---|---|---|---|---|---|---|---|---|
| $f_1$ | 0 | 1 | 1 | 1 | 1 | | 0 | 0 |
| $f_2$ | 1 | 0 | 1 | 0 | 0 | | 0 | 0 |
| $f_3$ | 1 | 1 | 0 | 1 | 0 | … | 0 | 0 |
| $f_4$ | 1 | 0 | 1 | 0 | 0 | | 0 | 0 |
| $f_5$ | 1 | 0 | 0 | 0 | 0 | | 1 | 1 |
| ⋮ | | | ⋮ | | | ⋱ | | |
| $f_{n-1}$ | 0 | 0 | 0 | 0 | 1 | | 0 | 1 |
| $f_n$ | 0 | 0 | 0 | 0 | 1 | | 1 | 0 |

Then the unexpectedness calculator 370 applies the following formula (2) to obtain the unexpected score:

$$\text{score}(u, f_i, f_j) = \left(1 + \sum_{k=1}^{n} F_{ik}\right)\left(1 + \sum_{k=1}^{n} F_{jk}\right)\left(1 + 2 \times \sum_{k=1}^{n} F_{ik}F_{jk}\right)^{-2} \quad (2)$$

Where $F_{mn}$ is the matrix element in the $m^{th}$ row and the $n^{th}$ column. The summation in the first factor calculates the number of friends $f_i$ and the target user have in common. The summation in the second term calculates the number of friends $f_j$ and the target user have in common. Finally the summation in the third term calculates the number of common friends between $f_i$, $f_j$ and the target user. As a result, this formula yields the same score as the previously describe embodiment of the unexpectedness calculator 370.

In another exemplary embodiment, the unexpectedness calculator 370 places the target user's friends into different clusters. For example, a friend can be part of a college friend cluster, summer camp cluster, and/or coworkers cluster. Then the unexpectedness calculator will identify unexpected friends by searching for connections between two different clusters. If a friend from the college friend cluster and a friend from the summer camp cluster are connected, there is high likelihood the relationship between the friend from the college friend cluster, and a friend from the summer camp cluster is unexpected to the target user.

Removing False Positives

The removal of false positives is performed by the false positive remover module 380. False positives happen when a pair of friends has a high unexpectedness score (i.e., score (u, $f_i$, $f_j$) is high) but the target user is aware of the connection between both friends. As a result, the relationship is not unexpected to the target user. False positives often occur due to the way users make connections in the social networking system. The relationship diagram in the social networking system may not reflect all the connections the target user has in the real world. For instance, users may not make a connection with their spouse's friends, even though they may know their spouse's friends in the real world. Therefore, usually the target user's spouse and the target user's spouse's friend that has a connection with the target user have a high unexpectedness score.

For example, in the exemplary relationship diagram of FIG. 1, the unexpectedness score between friend 110*b* and friend 110*f* can be calculated (i.e., score(user 100, friend 110*b*, friend 110*f*)). Friend 110*b* and the target user 100 have 4 friends in common making the second term in the numerator 5. Similarly friend 110*f* and the target user have 3 friends in common making the second term in the numerator 4. Since friend 110*b* and friend 110*f* are the same relationship circle, it would be expected that they share many friends in common but in this example, they do not share any friend, making the denominator term $[1+2*(\text{\# friends in common with friend } \mathbf{110}a\text{, friend } \mathbf{110}b \text{ and user } \mathbf{100})]^2$ to be equal to 1. As a result, the overall score computed by the unexpectedness calculator 370 is 20. This score is as high as the score assigned to the relationship between friend 110*a* and friend 110*b*. Consequently the unexpectedness calculator 370 will erroneously believe that the relationship between friend 110*b* and friend 110*f* is unexpected.

In one embodiment of the social networking system, the false positive remover 380 imposes a hard filter, removing all relationships that include the target user's spouse from the list of unexpected relationships. In another embodiment, the false positive remover 380 imposes a soft filter, only lowering the score by a predefined factor every time a pair of unexpected friends includes the target user's spouse. To apply the previously mentioned filters, the false positive remover 380 uses the relationship information available in the user profile. In one embodiment, the false positive remover 380 can identify the target user's spouse, ex-spouse, boyfriend/girlfriend, and/or ex-boyfriend/ex-girlfriend to impose such filters. In other embodiments, the false positive remover 380 can also access information regarding the user's relatives such as parents, sibling, and/or children to impose similar filters.

Another way of determining false positives is to identify content, such as photos, events, or posts, in the social networking system that relates both unexpected friends with the target user. For example, if both friends and the target user are all tagged in the same picture, then the relationship is not unexpected since the target user very likely has knowledge of such relationship. Other evidence that the target user has knowledge of a relationship include events that both friends and the target user attended; places, such as restaurants or bars, that both friends and the target user checked-in at the same time; and posts where both friends and the target user have commented about, in particular if the comment thread is not shared by a large number of users. Similar to the case where one of the friends in the unexpected relationship is the user's spouse, this information can be used to implement hard filters and/or soft filters onto the unexpectedness score.

Adjusting the Score

The adjustment of the unexpectedness score is performed by the score adjuster 390. In one embodiment, the score adjuster 390 adjusts the score is based on the content available in the social networking system that relates both unexpected friends. In general, the likelihood of the user being interested in an unexpected relationship is high if there is tangible proof of such relationship. Content that might increase the target user's interest in the relationship include photos in which the target user and both unexpected friends are tagged; information describing events that the target user and both unexpected users attended; and information describing places, such as restaurants or bars, that the target user and both unexpected friends checked-in at the same time.

The more content there is about the unexpected relationship, the more interesting the unexpected relationship is likely to be to the target user. Therefore, the unexpectedness score can be increased based on the content available in the social networking system that relates both unexpected friends. The content used to filter false positives and the content used to adjust the score may be different. To determine a false positive, the content available in the social networking system may contain both friends and the target user, whereas the content used to adjust the score higher may contain both unexpected friends but not the target user.

Other embodiments can also adjust the unexpectedness score based on the affinity between $f_i$ and $f_j$. Two users show high affinity if they interact regularly in the social networking system. For example, if both friend $f_i$ and friend $f_j$ post comments in each other's walls, this shows that they are constantly interacting with each other and their unexpectedness score can be adjusted upwards. Also the fact that the pair of friends has many connections in common could mean that they are part of a relationship circle of which the target user is not a member. This information can also be used to increase the unexpectedness score.

After the unexpectedness score has been determined, false positives have been removed, and the scores have been adjusted, the unexpected friends can be ranked based on the score provided by the unexpected relationship module 230. Then, the top ranked pair of friends can be shown to the target user along with the content available in the social networking system relating the pair of unexpected friends. One important fact to take into account is that once the unexpected relationship and the content relating both unexpected friends has been shown to the target user, this connection will no longer be unexpected and subsequent unexpectedness score calculation must take into account such information.

In an exemplary embodiment, the final scores are cached and stored for later use. Calculating the unexpected relationship scores is an expensive process in terms of computational power and computational time. Therefore caching the scores will allow users to access this information in a timely manner after being requested and it will prevent the system from overloading in case a large number of requests are received in a short period of time.

Figure 4:
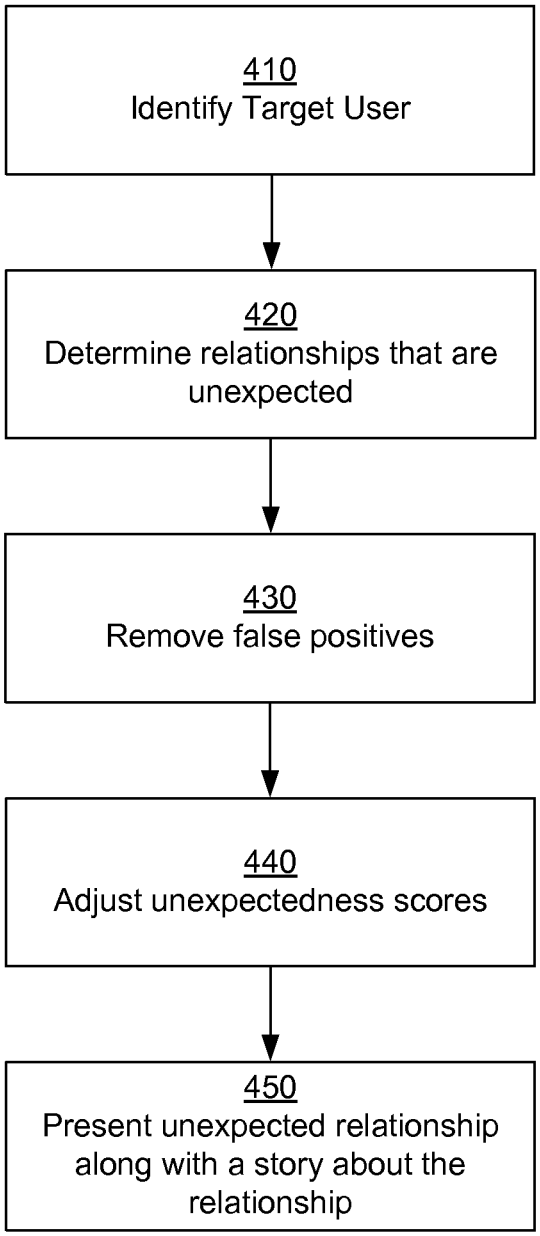
FIG. 4 is a flowchart of a process for identifying an unexpected relationship among a user's friends in a social networking system, in accordance with one embodiment of the invention.

FIG. 4 shows a flowchart of a process for identifying unexpected friends of a user in a social networking system, in accordance with an embodiment of the invention. The unexpectedness calculator 370 identifies 410 a target user. The unexpectedness calculator 370 then determines 420 the relationships that are unexpected to the identified target user. The false positive remover 380 removes 430 false positives based on the relationships information available in the user profile of the social networking system. The score adjuster 390 adjusts 440 the score based on content available in the social networking system relating the pair of unexpected friends, and based on the affinity of both unexpected friends. The results are presented 450 to the user along with a story relating both unexpected friends. The story presented can be in the form of a photo in which both unexpected friends are tagged, an event both unexpected friends attended, or a place both unexpected friends checked-in at the same time.

Alternative Applications

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a tangible computer readable storage medium or any type of media suitable for storing electronic instructions, and coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A computer implemented method comprising:

storing, by a social networking system, data representing a social graph comprising objects of the social networking system and connections describing relationships among the objects, the objects comprising a plurality of user profile objects representing users of the social networking system and a plurality of content objects;

identifying a target object, the target object connected to some of the plurality of user profile objects in the social graph;

identifying one or more pairs of user profile objects that are connected to the target object, the data representing the social graph indicating that the user profile objects in each pair are connected to each other in the social graph;

determining, for each of the identified pairs, a measure of unexpectedness with respect to the target object, the measure of unexpectedness indicative of a likelihood that the identified pair being connected is unexpected to a target user of the social networking system who is represented by the target object in the social graph, the determining comprising:

for each identified pair having a first identified object and a second identified object:

(i) identifying a first subset of the plurality of user profile objects that are connected to both the first identified object and the target object;

(ii) identifying a second subset of the plurality of user profile objects that are connected to both the second identified object and the target object;

(iii) identifying a third subset of the plurality of user profile objects that are connected to the first identified object, the second identified object, the target object;

(iv) determining the measure of unexpectedness as a value that is positively related to both a first number of objects in the first subset and a second number of objects in the second subset and that is inversely related to a third number of objects in the third subset;

determining, for each of the identified pairs, whether the identified pair belongs to a false positive based on determining whether a content object in the social graph is connected to the first identified object, the second identified object and the target object;

removing one or more of the identified pairs that are determined as false positives from selection;

selecting one of the identified pairs based on the measure of unexpectedness with respect to the target object;

selecting a particular content item associated with the selected pair; and transmitting the particular content item to the target user who is represented by the target object in the social graph.

2. The computer implemented method of claim 1, wherein the one or more of the identified pairs that are classified as false positives are classified further based on determining, for an identified pair, that the first identified object or the second identified object represents a spouse of the target user in the social graph.

3. The computer implemented method of claim 1, wherein determining whether a content object in the social graph is connected to the first identified object, the second identified object and the target object comprises determining whether the first identified object, the second object and the target object are each tagged in the content item in the social networking system.

4. The computer implemented method of claim 1, further comprising, for each identified pair:

determining that the first identified object or the second identified object represents a spouse of the target user; and decreasing the measure of unexpectedness.

5. The computer implemented method of claim 1, wherein the plurality of content objects each represents a content item selected from a group consisting of: an image, a check-in, a post, and any combination thereof.

6. The computer implemented method of claim 1, further comprising, for each of the identified pairs:

determining that the first identified object, the second identified object and the target object represent members of the same group in the social networking system; and decreasing the measure of unexpectedness.

7. The computer implemented method of claim 1, further comprising:

increasing the measure of unexpectedness for a particular identified pair based on an affinity between the first identified object and the second identified object.

8. The computer implemented method of claim 1, wherein the transmitted particular content item is transmitted with a description of unexpectedness of the selected pair to the target user.

9. The method of claim 1 further comprising:

clustering the plurality of user profile objects in the social graph connected to the target object into a plurality of clusters, wherein, for at least one of the identified pairs, the first identified object is clustered in a first cluster and the second identified object is clustered in a second cluster.

10. A non-transitory computer-readable storage medium storing computer-executable instructions, the instructions, when executed by a processor, cause the processor to perform steps comprising:

storing, by a social networking system, data representing a social graph comprising objects of the social networking system and connections describing relationships among the objects, the objects comprising a plurality of user profile objects representing users of the social networking system and a plurality of content objects, identifying a target object, the target object connected to some of the plurality of user profile objects in the social graph;

identifying one or more pairs of user profile objects that are connected to the target object, the data representing the social graph indicating that the user profile objects in each pair are connected to each other in the social graph;

determining, for each of the identified pairs, a measure of unexpectedness with respect to the target object, the measure of unexpectedness indicative of a likelihood that the identified pair being connected is unexpected to a target user of the social networking system who is represented by the target object in the social graph, the determining comprising:

for each identified pair having a first identified object and a second identified object:

(i) identifying a first subset of the plurality of user profile objects that are connected to both the first identified object and the target object;

(ii) identifying a second subset of the plurality of user profile objects that are connected to both the second identified object and the target object, (iii) identifying a third subset of the plurality of user profile objects that are connected to the first identified object, the second identified object, the target object;

(iv) determining the measure of unexpectedness as a value that is positively related to both a first number of objects in the first subset and a second number of objects in the second subset and that is inversely related to a third number of objects in the third subset;

determining, for each of the identified pairs, whether the identified pair belongs to a false positive based on determining whether a content object in the social graph is connected to the first identified object, the second identified object and the target object;

removing one or more of the identified pairs that are determined as false positives from selection;

selecting one of the identified pairs based on the measure of unexpectedness with respect to the target object;

selecting a particular content item associated with the selected pair; and transmitting the particular content item to the target user who is represented by the target object in the social graph.

11. The non-transitory computer-readable storage medium of claim 10, wherein the one or more of the identified pairs that are classified as false positives are classified further based on determining, for an identified pair, that the first identified object or the second identified object represents a spouse of the target user in the social graph.

12. The non-transitory computer-readable storage medium of claim 10, wherein the steps further comprises, for each identified pair:

determining that the first identified object or the second identified object represents a spouse of the target user; and decreasing the measure of unexpectedness.

13. The non-transitory computer-readable storage medium of claim 10, wherein the plurality of content objects each represents a content item selected from a group consisting of: an image, a check-in, a post, and any combination thereof.

14. The non-transitory computer-readable storage medium of claim 10, further comprising, for each of the identified pairs:

determining that the first identified object, the second identified object and the target object represent members of the same group in the social networking system; and decreasing the measure of unexpectedness.

15. The non-transitory computer-readable storage medium of claim 10, further comprising:

increasing the measure of unexpectedness for a particular identified pair based on an affinity between the first identified object and the second identified object.

16. The non-transitory computer-readable storage medium of claim 10, wherein the transmitted particular content item is transmitted with a description of unexpectedness of the selected pair to the target user.

17. The non-transitory computer-readable storage medium of claim 10, wherein the steps further comprise:

clustering the plurality of user profile objects in the social graph connected to the target object into a plurality of clusters, wherein, for at least one of the identified pairs, the first identified object is clustered in a first cluster and the second identified object is clustered in a second cluster.

* * * * *